US008327509B2

(12) United States Patent
Kusayama

(10) Patent No.: US 8,327,509 B2
(45) Date of Patent: Dec. 11, 2012

(54) LIQUID-TIGHT SLIDE FASTENER

(75) Inventor: Masahiro Kusayama, Toyama-ken (JP)

(73) Assignee: YKK Corporation (JP)

( * ) Notice: Subject to any disclaimer, the term of this patent is extended or adjusted under 35 U.S.C. 154(b) by 1177 days.

(21) Appl. No.: 12/024,216

(22) Filed: Feb. 1, 2008

(65) Prior Publication Data

US 2008/0189918 A1 Aug. 14, 2008

(30) Foreign Application Priority Data

Feb. 8, 2007 (JP) ..... 2007-029012

(51) Int. Cl.
*A44B 19/12* (2006.01)
*A44B 19/32* (2006.01)

(52) U.S. Cl. ..... 24/389; 24/394

(58) Field of Classification Search ..... 24/384, 24/389, 394
See application file for complete search history.

(56) References Cited

U.S. PATENT DOCUMENTS 3,914,827 A * 10/1975 Brown et al. ..... 24/394
4,580,321 A * 4/1986 Tanikawa et al. ..... 24/389
4,888,859 A * 12/1989 Horita ..... 24/389
6,105,214 A 8/2000 Press

FOREIGN PATENT DOCUMENTS

JP 58-118853 7/1983
JP 60-96650 A 5/1985
JP 7-150045 A 6/1995

* cited by examiner

*Primary Examiner* — James Brittain
(74) *Attorney, Agent, or Firm* — Kilpatrick Townsend & Stockton LLP

(57) ABSTRACT

A liquid-tight slide fastener, wherein a pair of right and left coil-like coupling element rows, through which a core thread is respectively passed, is attached by sewing along opposing side edges of a pair of right and left fastener tapes, the fastener tapes having a liquid-tight layer on one surface thereof, and the core thread is coated with a water repellent agent or oil repellent agent. Consequently, even if water or oil invades into a space portion in the coupling element rows through a joint portion in the liquid-tight slide fastener, the core thread repels the water or oil, thereby blocking a further invasion of water or oil, and exerting excellent water repellency or oil repellency without provision of a water stop flap.

2 Claims, 12 Drawing Sheets

FIG. 12

TEST RESULT OF TEST PIECE ACCORDING TO PRECIPITATION TEST METHOD B

TEST CONDITION
- LEVELING DEVICE : 100mm/h
- RAINFALL TIME : 15 min
- TEST PIECE : 15mm × 200mm
- TEST PIECE ANGLE : 45°

UNIT (g)

| TEST PIECE | (1) COMPARATIVE EXAMPLE | | | (2) EXAMPLE 1 | | | (3) EXAMPLE 2 | | |
|---|---|---|---|---|---|---|---|---|---|
| FREQUENCY | WATER CONTENT IN FASTENER PORTION A=(M2−M0) | WATER ABSORPTION OF GROOVE PORTION B=(M3−M1) | AMOUNT OF PERMEATION A+B | WATER CONTENT IN FASTENER PORTION A=(M2−M0) | WATER ABSORPTION OF GROOVE PORTION B=(M3−M1) | AMOUNT OF PERMEATION A+B | WATER CONTENT IN FASTENER PORTION A=(M2−M0) | WATER ABSORPTION OF GROOVE PORTION B=(M3−M1) | AMOUNT OF PERMEATION A+B |
| 1 | 1.40 | 0.42 | 1.82 | 0.019 | 0.000 | 0.019 | 0.013 | 0.005 | 0.018 |
| 2 | 1.44 | 0.54 | 1.98 | 0.019 | 0.000 | 0.019 | 0.019 | 0.003 | 0.022 |
| 3 | 1.45 | 0.73 | 2.18 | 0.015 | 0.000 | 0.015 | 0.019 | 0.003 | 0.022 |
| AVERAGE | 1.43 | 0.56 | 1.99 | 0.018 | 0.000 | 0.018 | 0.017 | 0.004 | 0.021 |

LIQUID-TIGHT SLIDE FASTENER

INCORPORATION BY REFERENCE

The present application claims priority under 35 U.S.C. §119 to Japanese Patent Application No. 2007-029012 filed on Feb. 8, 2007. The content of the application is incorporated herein by reference in its entirety.

BACKGROUND OF THE INVENTION

1. Field of the Invention

The present invention relates to a liquid-tight slide fastener for use at an opening of clothes, cases, bags and the like requiring water repellency or oil repellency and a method for manufacturing the liquid-tight slide fastener.

2. Description of the Related Art

Conventionally, there has been known a slide fastener having waterproof property due to lamination of a polyurethane film on the surface of a fastener tape on an opposite side to a coupling element mounting surface of a slide fastener on which coil-like coupling element rows are sewed. FIG. 13 shows a perspective view of the slide fastener having waterproof property. In the meantime, FIG. 13 shows a part of the slide fastener.

As shown in FIG. 13, a slide fastener 910 includes a pair of right and left coil-like coupling element rows 912, a pair of fastener tapes 916, and a slider 920. A core thread 914 is passed through the pair of right and left coil-like coupling element rows 912. The coupling element rows 912 are sewed with a sewing yarn 915 on the pair of fastener tapes 916. The slider 920 is arranged for engaging/disengaging the pair of coupling elements 912. Further, in the slide fastener 910 shown in FIG. 13, one surface of the fastener tape 916 is covered with a liquid-tight layer 918 made of thermoplastic elastomer such as polyurethane to be protected from outside. The liquid-tight layer 918 is formed by bonding on the surface opposite to an element column mounting surface of the fastener tape 916 with an adhesive.

When the pair of coupling element rows 912 in the slide fastener 910 shown in FIG. 13 are coupled with each other, water cannot easily enter a coupling portion of the coupling element rows 912 due to existence of the liquid-tight layer 918, so that a water repellent effect can be secured to some extent. However, because a gap (W1) always remains formed on opposing side edges of the pair of liquid-tight layers 918 although quite slightly, water invades up to near a space portion 930 formed between the side edges of the pair of fastener tapes 916 at the coupling portion and a coupling head of the coupling element rows 912.

A sectional view of a slide fastener 810 shown in FIG. 14 is shown in FIG. 1 of U.S. Pat. No. 6,105,214. The slide fastener 810 includes a pair of coupling element rows 822 mounted on stringer tapes 814, 816 and also includes liquid-tight layer 826 for preventing invasion of water. The following technique has been described in U.S. Pat. No. 6,105,214 (page 4, lines 58 to 64). That is, water repellent processing such as fluorine treatment is applied to a surface or a non-coating surface 818 on an opposite side to the surface of the stringer tapes 814, 816 on which coupling element rows 822 are attached.

When the slide fastener 910 shown in FIG. 13 is used in a plane condition and in a closed state, the gap (W1) at the joint portion is very small because the opposing side edges of the liquid-tight layers 918 in pairs formed of polyurethane or the like exist in proximity of each other. Thus, although the effect of water repellency can be expected to some extent, there is still generated such a fault that water invades through the joint portion. Further, the slide fastener 910 shown in FIG. 13 may be used for bags and a content may be accommodated inside thereof. In such a case, particularly when that content exceeds the capacity of the bag, an extremely large lateral pulling force is applied to the slide fastener 910, so that the gap (W1) at the joint portion is widened, thereby producing a fault that water can invade more easily. If the slide fastener 910 shown in FIG. 13 is used for clothes such as sportswear and a person wearing the clothes makes a violent action, the slide fastener 910 is deformed by the action, so that the gap (W1) at the joint portion of the slide fastener 910 is inclined to be widened thereby deteriorating the water repellent performance.

FIG. 15 shows an example of the application of the conventional slide fastener 910 to a bag 940.

As shown in the same figure, the bag 940 is formed so as to be easily openable and closable by sewing the slide fastener 910 from a top surface 942 of the bag 940 up to a corner portion 944 and a side surface 946 thereof. At this time, the gap (W1) at the joint portion formed by the opposing side edges of the pair of opposing liquid-tight layers 918 is small at the top surface 942 and the side surface 946 of the bag 940. However, particularly at the corner portion 944 of the bag 940, the opposing side edges of the pair of liquid-tight layers 918 become likely to open so that a gap (W2) at the joint portion is widened. In a situation where water droplets are splashed onto the bag 940, more water invades into the space portion 930 (see FIG. 13) of the slide fastener 910 through the gap (W2) at the joint portion of the pair of liquid-tight layers 918.

Because water having invaded into the space portion 930 permeates the pair of core threads 914 and continues to invade inside of the bag 940 through the sewing yarn 915 due to the capillary phenomenon, the inside of the bag 940 is wetted gradually.

Even if, as shown in FIG. 14, ordinary water repellent treatment is carried out on a non-coating surface 818 of the slide fastener 810 described in U.S. Pat. No. 6,105,214, the water repellent treatment is never performed on the entire surface of the coupling element rows 822 securely. Further, the water repellent treatment is never performed securely on the joint portion between the stringer tapes 814 and 816. For the reason above mentioned, water having penetrated the stringer tapes 814, 815 through the joint portion of the liquid-tight layers 826 of the slide fastener 810 invades inside of the bag through the stringer tapes 814, 816 themselves and the surface of the coupling element rows.

To improve water stop performance in the above-described conventional slide fastener, a water stop flap needs to be provided at the joint portion of the slide fastener. However, if the water stop flat is provided on the slide fastener, efficiency of sewing operation for the slide fastener is deteriorated and it becomes very difficult to open/close the slide fastener.

SUMMARY OF THE INVENTION

The present invention has been made to solve these problems possessed by the prior art, and an object of the invention is to improve the water repellent and oil repellent performance of the slide fastener without providing with any special water stop flap.

To achieve the above-described object, the present invention provides a liquid-tight slide fastener in which a pair of right and left coil-like coupling element rows, through which a core thread is respectively passed, are attached by sewing along opposing side edges of a pair of right and left fastener tapes, the fastener tapes having a liquid-tight layer on one surface thereof, being characterized in that the core thread is coated with a water repellent agent or oil repellent agent.

According to a preferred embodiment, the coupling element rows or the fastener tapes are coated with the water repellent agent or oil repellent agent.

To achieve the above described object, a first method for manufacturing a liquid-tight slide fastener of the present invention comprises: a step of sewing a pair of right and left coil-like coupling element rows, through which a core thread is respectively passed, onto opposing side edges of a pair of right and left fastener tapes; a step of, with the pair of right and left coupling element rows coupled with each other, forming a liquid-tight layer on surfaces on an opposite side to surfaces of the pair of right and left fastener tapes on which the coupling element rows are sewed; and a step of cutting the liquid-tight layer along a coupling portion at which the pair of coupling element rows is coupled with each other, being characterized by further comprising a step of applying a water repellent agent or oil repellent agent to at least a portion of the core thread to settle the water repellent agent or oil repellent agent on the portion of the core thread.

According to a preferred embodiment, the manufacturing method may further comprise: a step of, when the water repellent agent or oil repellent agent is applied to the portion of the core thread, disposing a roller on surfaces on the opposite side to the surfaces of the fastener tapes, on which the coupling element rows exist; and winding a fastener chain along a peripheral surface of the roller so as to curve the fastener chain at a predetermined angle θ, thereby expanding a gap between the coupling element rows to accelerate a permeation of the water repellent agent or oil repellent agent into insides of the coupling element rows.

To achieve the above described object, a second method for manufacturing a liquid-tight slide fastener of the present invention comprises: a step of inserting a core thread coated with a water repellent agent or oil repellent agent through each of a pair of right and left coil-like coupling element rows; a step of sewing the coil-like coupling element rows, through which the core thread is respectively passed, onto opposing side edges of a pair of right and left fastener tapes; a step of, with the pair of right and left coupling element rows coupled with each other, forming a liquid-tight layer on surfaces on an opposite side to surfaces of the pair of right and left fastener tapes on which the coupling element rows are sewed; and a step of cutting the liquid-tight layer along a coupling portion at which the pair of coupling element rows is coupled with each other, being characterized by further comprising a step of, before the core thread is passed through the coil-like coupling element row, applying a water repellent agent or oil repellent agent to the core thread in advance.

According to a preferred embodiment, in addition to the second manufacturing method, the manufacturing method may further comprise a step of further applying the water repellent agent or oil repellent agent to the coupling element rows or the fastener tapes.

A liquid-tight slide fastener of the present invention is manufactured according to the first and second manufacturing methods of the present invention. Thus, the core thread, which is passed through the inside of each of the pair of right and left coil-like coupling element rows, is coated with the water repellent agent or oil repellent agent. Consequently, even if water or oil invades into a space portion between the liquid-tight layer and the coupling element rows through a joint portion of the liquid-tight layers made of polyurethane or the like formed on a single surface of the fastener tape, the core thread repels water or oil. Then, water or oil invading through the joint portion of the liquid-tight layers is repelled by the surface of the core thread and remains deposited in the space portion between the liquid-tight layers and coupling element rows, thereby blocking water or oil from invading further through the joint portion of the liquid-tight layers.

If the liquid-tight slide fastener is used at a corner portion of a bag, generally, the liquid-tight slide fastener is bent, so that the joint portion of the liquid-tight layers may be opened slightly or a large lateral pulling force is applied to the liquid-tight slide fastener due to existence of a content in the bag and consequently, the gap at the joint portion may be expanded. Even if the gap at the joint portion is expanded, water or oil is held in the space portion and prevented from invading further, because the core thread disposed along the space portion between the joint portion of the liquid-tight layers and the coupling element rows in the liquid-tight slide fastener of the present invention is subjected to water repellent treatment or oil repellent treatment.

According to the preferred embodiment, the coupling element rows and/or the fastener tapes are coated with a water repellent agent or oil repellent agent, in order to prevent water or oil from permeating the coupling element rows or the fastener tapes. Consequently, water or oil deposit is maintained in the space portion between the liquid-tight layer and the coupling element row, thereby preventing water or oil from further invading through the joint portion of the liquid tight layers.

By constituting the liquid-tight slide fastener in this way, predetermined water repellency can be obtained without providing a water stop flap difficult to handle at the joint portion in the liquid-tight slide fastener. Further, water repellency or oil repellency can be improved by applying a water repellent agent or oil repellent agent to an entire surface of a liquid-tight slide fastener having a top end stop, bottom end stop or separable bottom end stop.

According to the first manufacturing method, the water repellent agent or oil repellent agent cannot be, in some cases, supplied to part of the core thread due to existence of the coupling element rows. However, the water repellent effect or oil repellent effect of the core thread is compensated by the water repellent effect or oil repellent effect of the surface of the fastener tape and the coupling element rows by performing water repellent treatment or oil repellent treatment on the fastener tape and the coupling element rows as well as the core thread. Consequently, the water repellent effect or oil repellent effect of the entire liquid-tight slide fastener is improved extremely.

According to the second manufacturing method, the core thread is subjected to water repellent treatment or oil repellent treatment in advance. Consequently, the water repellent effect or oil repellent effect is exerted over the entire core thread although manufacturing efficiency is dropped slightly. As a result, a liquid-tight slide fastener which can exert further water repellent effect or oil repellent effect is obtained. The effects which the present invention exerts are considerably great.

BRIEF DESCRIPTION OF THE DRAWINGS

FIG. 12 is a table showing a result of the precipitation test performed for the liquid-tight slide fastener of the present invention and a conventional polyurethane film provided fastener;

DESCRIPTION OF THE PREFERRED EMBODIMENTS

Hereinafter, typical embodiments of a liquid-tight slide fastener of the present invention will be described in detail with reference to the accompanying drawings.

Figure 1:
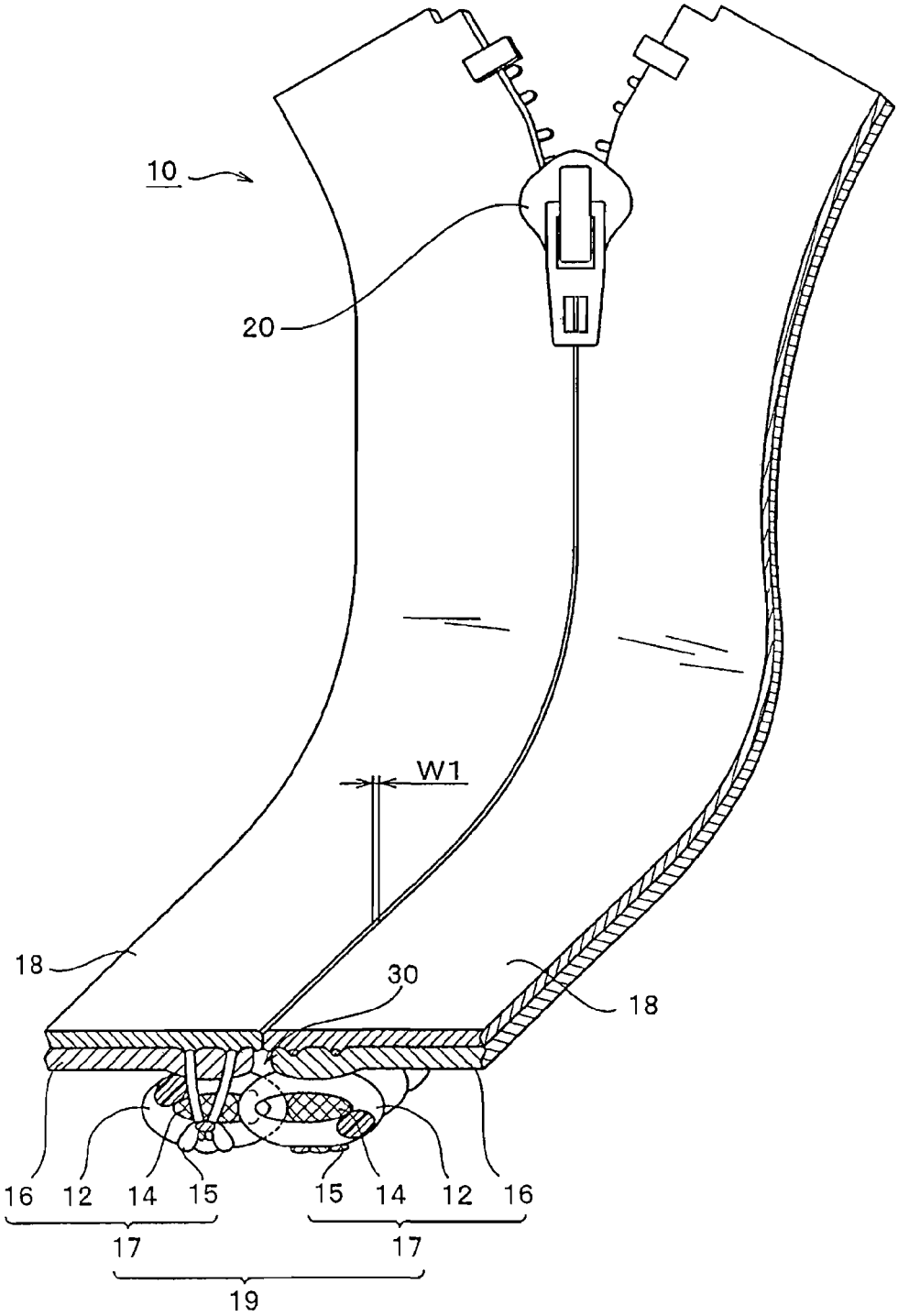
FIG. 1 is an external perspective view of a liquid-tight slide fastener according to a first embodiment of the present invention or a view showing a state in which a part of a liquid-tight slide fastener is broken in order to explain the inside of coupling element rows.

FIG. 1 is an external perspective view of a liquid-tight slide fastener according to a first embodiment of the present invention. FIG. 1 shows a section obtained by cutting a part of the liquid-tight slide fastener in order to explain the interior of coupling element rows.

As shown in FIG. 1, a liquid-tight slide fastener 10 of the present invention includes a pair of right and left coil-like coupling element rows 12, a core thread 14 whose surface is coated with a water repellent agent, a pair of fastener stringers 17 obtained by sewing the coupling element rows 12 and the core thread 14 along opposing side edges of fastener tapes 16 with a sewing yarn 15, a slider 20 caused to slide when the pair of coupling element rows 12 are coupled with or decoupled from each other, and a liquid-tight layer 18 for covering the surface opposite to the surface of the fastener tapes 16 on which the coupling element rows 12 are attached. In the fastener chain 19 shown in FIG. 1, the pair of fastener stringers 17 are coupled with each other by the coupling element rows 12.

The liquid-tight layer 18 is a resin layer made of polyurethane, polyolefin or the like and integrated with the fastener tape 16 by fusion or bonding. As the liquid-tight layer 18, layers having the surface subjected to embossing treatment as ornament may be used.

According to the first embodiment, with the pair of right and left coupling element rows 12 coupled with each other, the liquid-tight layer 18 is formed on the surface of the fastener tape 16 (surface side to the surface on which the coupling element rows 12 are sewed), and thereafter, the liquid-tight layer 18 is cut to two sections along the coupling portion at which the pair of right and left coupling elements 12 are coupled with each other, so that the opposing side edges of the pair of right and left liquid-tight layers 18 make firm contact with each other. However, an extremely slight gap (W1) is formed between the opposing side edges of the pair of right and left liquid-tight layers 18. Because this gap (W1) is extremely small, water droplets are repelled by the water repellency of the liquid-tight layer 18 and some extent of the water repellent performance can be obtained.

Further, according to this embodiment, at least the surface of the core thread 14 is coated with the water repellent agent. Consequently, even when water invades into the space portion 30 formed between the pair of fastener tapes 16 and the coupling element rows 12 through the slight gap (W1) in the pair of liquid-tight layers 18, water never penetrates to the rear side of the slide fastener through the core thread 14 due to the water repellency effect that the core thread 14 passed through the coupling element row 12 repels water but is collected in the vicinity of the space portion 30. As a result, water collected in the space portion 30 prevents more water from invading through the joint portion and thus, it is not necessary to provide any water stop flap at the joint portion of the liquid-tight layers 18, thereby ensuring a predetermined water repellent performance.

According to this embodiment, not only the surface of the core thread 14 is coated with the water repellent agent but also the coupling element rows 12 and/or the fastener tapes 16 are also coated with the water repellent agent. This configuration more effectively prevents penetration of water from the space portion 30 through the coupling element rows 12 and/or the fastener tapes 16, thereby further improving the water repellent performance. Particularly, it is more advantageous that both the coupling element rows 12 and the fastener tapes 16 are coated with the water repellent agent in order to prevent water penetration.

Further, the water repellent performance can be improved by coating the core thread 14 with an oil repellent agent which repels oil. Like the application of the water repellent agent described above, the oil repellent performance can be further improved by coating the coupling element rows 12 and/or the fastener tapes 16 with an oil repellent agent.

In the above description, the embodiment has been explained in which the liquid-tight layer 18 is cut along the coupling portion of the coupling element rows 12 into two sections after forming the liquid-tight layer 18. However, this indicates a preferred embodiment, and other formation means for the liquid-tight layer 18 may be used. For example, with the right and left fastener stringers 17 separated from each other, the liquid-tight layer 18 is formed on the respective fastener stringers. In this case, it is preferable to select a material capable of bearing heat treatment for the liquid-tight layer 18.

Figure 2:
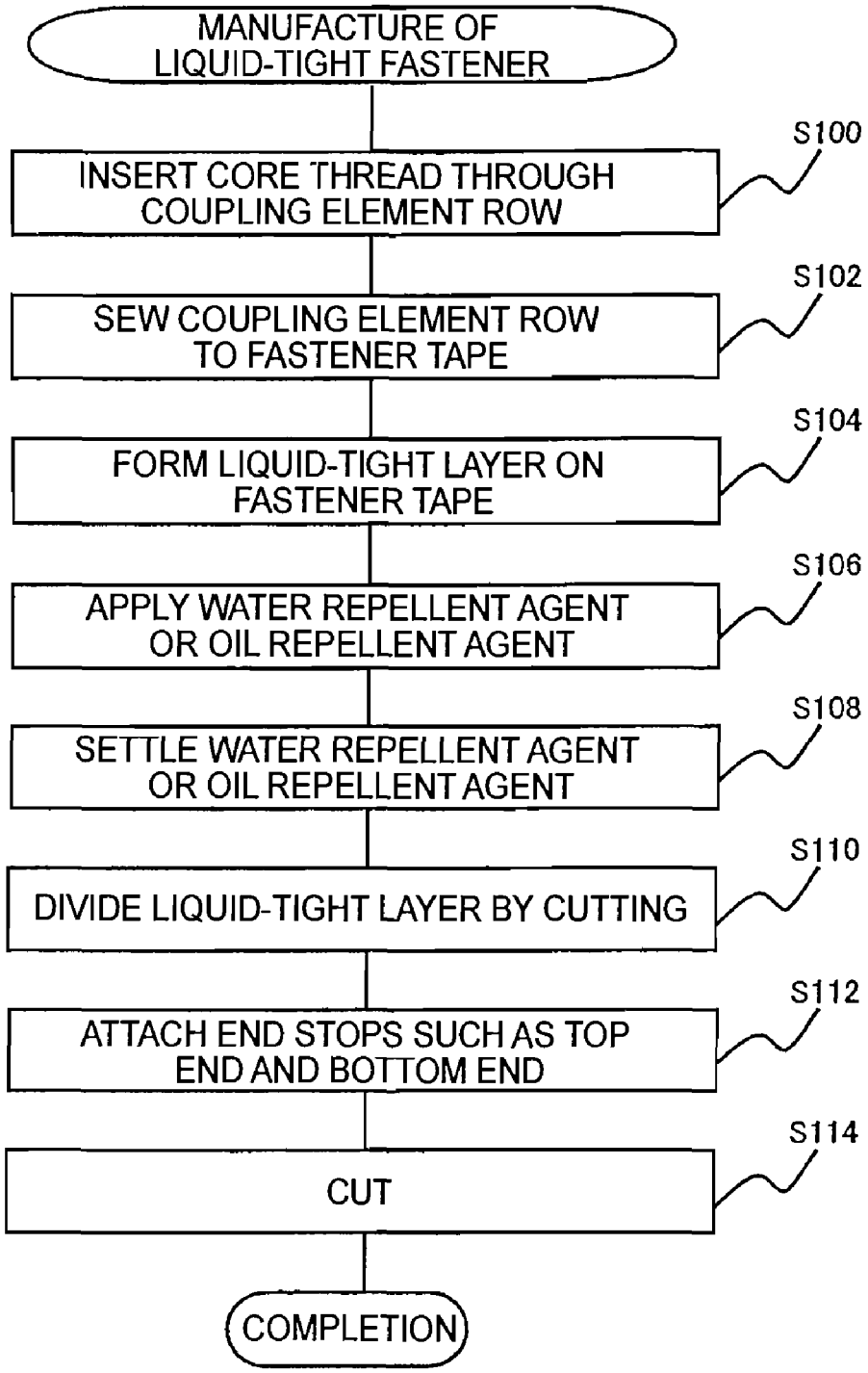
FIG. 2 is a process chart showing a first embodiment of a method for manufacturing the liquid-tight slide fastener.

Next, a method for manufacturing the liquid-tight slide fastener 10 will be described with reference to FIG. 2. FIG. 2 is a process chart showing a first embodiment of the method for manufacturing the liquid-tight slide fastener 10. In this process, the coupling element rows 12 and the core thread 14 are sewed onto the fastener tape 16 using the sewing yarn 15. Thereafter, the liquid-tight layer 18 is formed on the entire surface opposite to the element mounting surface of the fastener tape 16 so as to apply a water repellent agent or oil repellent agent, thereby manufacturing the liquid-tight slide fastener 10.

Upon manufacturing the liquid-tight slide fastener 10, the molded coil-like coupling element rows 12 and the core thread 14 obtained by knitting fibers such as polyester are prepared in advance. In step S100 "Insert the core thread into the coupling element row" (hereinafter described like S100 by omitting the detail description) shown in FIG. 2, the core thread 14 is inserted through the central portion of the coil-like right and left coupling element rows 12 in pair.

In next S102 "Sew the coupling element rows on the fastener tape", the pair of right and left coil-like coupling element rows 12 through which the core thread 14 is passed in S100 are sewed along the opposing side edges of the pair of right and left fastener tapes 16. Then, the coupling element rows 12 of the pair of fastener stringers 17 are coupled with each other so as to form the fastener chain 19.

In next S104 "Form the liquid-tight layer on the fastener tape", the liquid-tight layer made of a polyurethane film or the like is integrated by bonding or fusion with the surface of the fastener chain 19 on a side on which the coupling element row 12 is not sewed. Consequently, in the fastener chain 19, the common liquid-tight layer 18 is bonded integrally to the pair of right and left fastener tapes 16.

In next S106 "Apply water repellent agent or oil repellent agent", the fastener chain 19 after the liquid-tight layer 18 is joined in S104 is wound along the peripheral surface of a guide roller (not shown) and guided and then passed continuously within a container filled with a water repellent agent or oil repellent agent, so that the fastener chain 19 is dipped in the water repellent agent or oil repellent agent. In this processing of S106, the water repellent agent or oil repellent agent is efficiently applied to the entire surfaces of the coupling element rows 12, the core thread 14, the sewing yarn 15, the fastener tape 16 and the liquid-tight layer 18 which constitute the fastener chain 19.

Time for keeping the fastener chain 19 dipped in the water repellent agent or oil repellent agent is 1 second to several seconds. Although an example of using a fluorinated water repellent/oil repellent agent as the water repellent agent has been indicated below, the present invention is not restricted to the water repellent/oil repellent agent.

In next S108 "Apply water repellent agent or oil repellent agent", the fastener chain 19 after dipped in the container filled with the water repellent agent or oil repellent agent in S106 is pulled out of the container and passed through a dry chamber continuously so as to dry the water repellent agent or oil repellent agent applied on the entire surface of the fastener chain 19. The dry condition at this time is about two minutes under 110° C.

After the drying of the water repellent agent or oil repellent agent is completed, the fastener chain 19 is passed through the heat treatment chamber continuously so as to execute heat treatment on the dried water repellent agent or oil repellent agent. In this heat treatment, fusion and settlement are carried out between the water repellent agent or oil repellent agent and all base materials such as the coupling element row 12, the core thread 14, the sewing yarn 15, the fastener tape 16 and the liquid-tight layer 18. Upon the fusion and settlement, the water repellent agent or oil repellent agent is oriented perpendicularly to the surface of the base material, so that the water repellent agent or oil repellent agent adheres to the surface of the coupling element rows 12, the core thread 14, the sewing yarn 15, the fastener tape 16 and the liquid tight layer 18.

This heat treatment is carried out for about 1 minute under 170° C. different from the aforementioned drying time. However, if the fastener chain 19 is dyed, the color may be faded if the temperature of the heat treatment is long. In that case, the treatment time is increased by lowering the heat treatment temperature appropriately.

In next S110 "Divide the liquid-tight layer by cutting", the fastener chain 19 after the heat treatment is completed in S108 is taken out and the single unit liquid-tight layer 18, which joins the pair of right and left fastener stringers 17, is divided into two sections by cutting it with a cutter in the length direction along the coupling portion at which the pair of coupling element rows 12 are coupled with each other.

In case of dividing the liquid-tight layer 18 by cutting after the water repellent agent or oil repellent agent is applied, the aforementioned gap (W1) between the opposing side edges of the pair of right and left liquid-tight layers 18 can be decreased as compared with a case of forming the liquid-tight layer on each of the right and left fastener stringers 17. The gap is generated when the coupling element rows 12 are coupled with each other by operating the slider 20 in the completed liquid-tight slide fastener.

Next, in S112 "Attach the end stops such as top end stop and bottom end stop", a predetermined portion of the coupling element row 12 is cut and removed in the fastener chain 19 in which the division of the liquid tight layer 18 by cutting is completed in S110, thereby to form a space portion of the coupling element row 12. Then, the slider 20 is mounted on the coupling element rows 12 through the space portion and the end stops such as the top end stop, bottom end stop and releasable bottom end stop are mounted on the fastener tape 16 in accordance with the length of the liquid-tight slide fastener 10. Thereafter, in S114 "Cut", the fastener tape 16 is cut to a predetermined length so as to complete the liquid-tight slide fastener 10.

In the method for manufacturing the liquid-tight slide fastener 10 shown in FIG. 2, the liquid-tight layer 18 is divided to two sections by cutting the liquid-tight layer 18 in next S110 after the water repellent agent or oil repellent agent is applied in S108. This reason is to prevent the following fault. More specifically, if the heat treatment for applying a water repellent agent or oil repellent agent is carried out after the liquid-tight layer 18 is divided by cutting when a material which is contracted by being heated as the liquid-tight layer 18, the pair of right and left liquid-tight layers 18 are contracted so that the gap (W1) between the liquid-tight layers 18 is expanded, whereby the water repellent performance is dropped.

In the method for manufacturing the liquid-tight slide fastener 10 shown in FIG. 2, the liquid-tight layer 18 is divided into two sections by cutting after the water repellent agent or oil repellent agent is applied to the liquid-tight layer 18 by carrying out heat treatment on the fastener chain 19. Thus, even if the material which is contracted by being heated is used as the liquid-tight layer 18, the gap (W1) between the right and left liquid-tight layers 18 in pair is prevented from being increased, thereby maintaining a desired water repellent performance.

Figure 3:
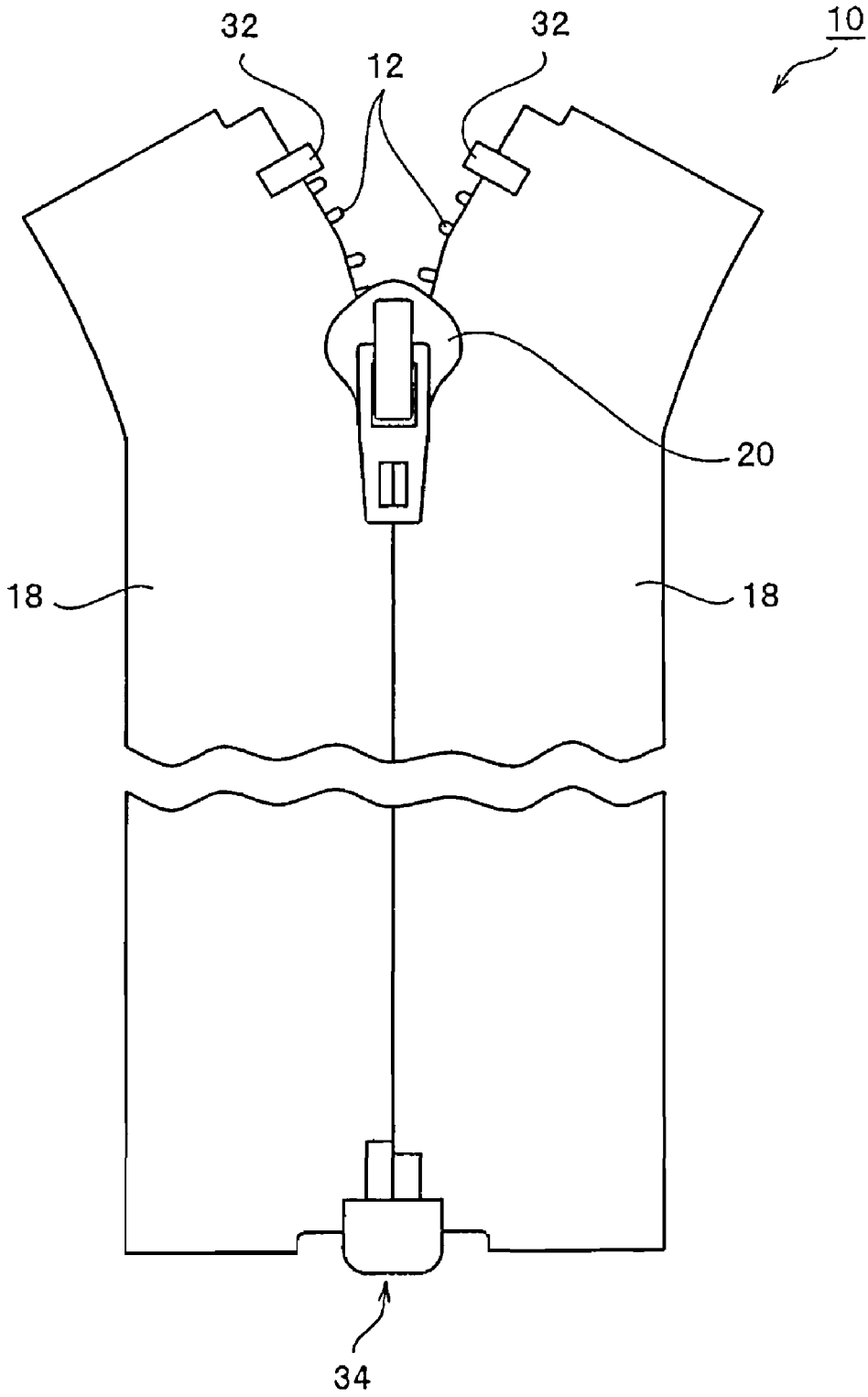
FIG. 3 is an external view showing a state in which the liquid-tight slide fastener is completed.
Figure 4:
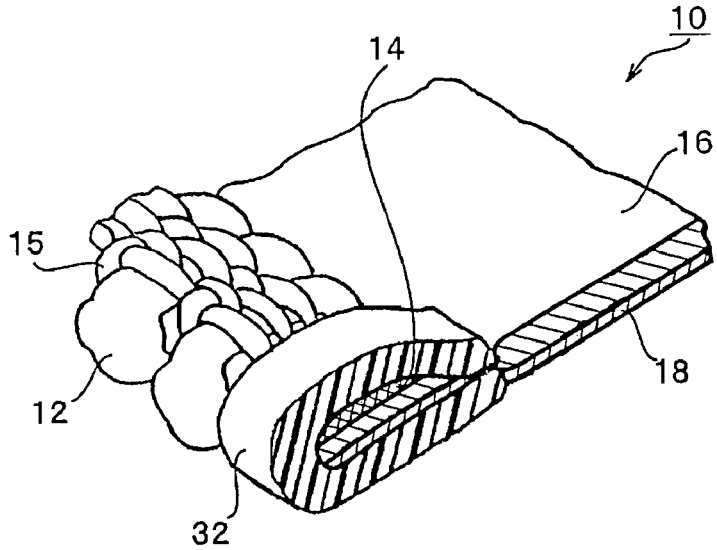
FIG. 4 is a view showing a section of a top end stop of the liquid-tight slide fastener.
Figure 5:
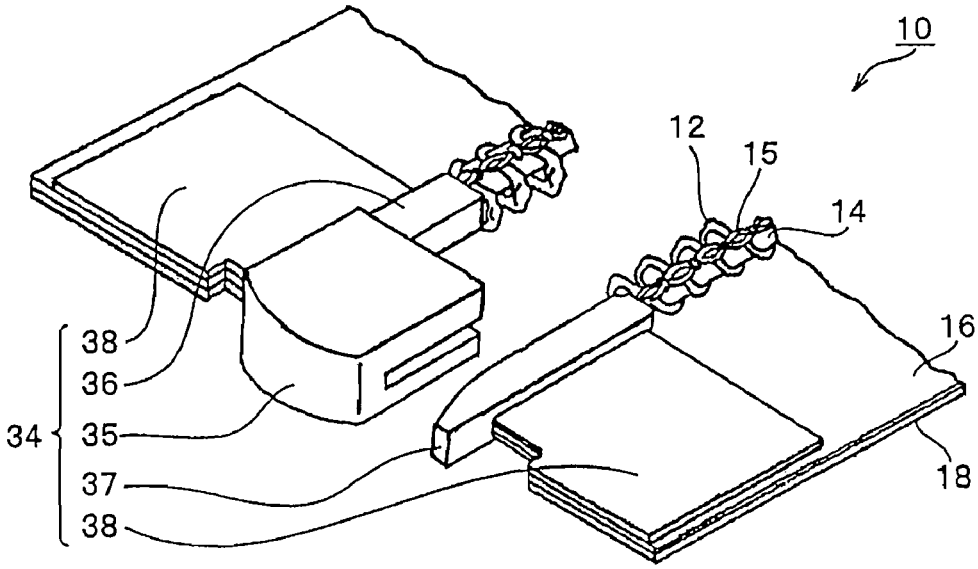
FIG. 5 is a view showing a state in which a separable bottom end stop is mounted on the liquid-tight slide fastener.

FIG. 3 shows an external view of a state in which the liquid-tight slide fastener 10 is completed. FIG. 4 shows a sectional view of a top end stop of the liquid-tight slide fastener 10. FIG. 5 shows a state in which a separable bottom end stop 34 is attached to the liquid-tight slide fastener 10. Like reference numerals are attached to the same components as described in FIG. 1, and description thereof is omitted.

The liquid-tight slide fastener 10 shown in FIG. 3 includes a pair of right and left top end stops 32 on the upper portion of the liquid-tight slide fastener 10 and the separable bottom end stop 34 on the bottom thereof. Consequently, the pair of coupling element rows 12 can be coupled with or decoupled from each other in such a manner that a slider 20 of the liquid-tight slide fastener 10 is slid between the top end stop 32 and the separable bottom end stop 34. When the pair of coupling element rows 12 are coupled with each other in a plane state without applying any special force to the liquid-tight slide fastener 10 as shown in FIG. 3, the opposing side edges of the pair of right and left liquid-tight layers 18 almost keep contact with each other. For this reason, the gap (W1) between the right and left liquid-tight layers 18 in pair is small, whereby the right and left liquid-tight layers are almost in a firm contact with each other.

Next, the detail in the vicinity of the top end stop 32 will be described with reference to FIG. 4. FIG. 4 is an enlarged view of a part in the vicinity of the top end stop 32 of the liquid-tight slide fastener 10 or a perspective view showing a fixing portion of the top end stop 32 with its section. As shown in FIG. 4, the top end stop 32 is attached to the upper portion of the liquid-tight slide fastener 10 in order to prevent the slider 20 from slipping out of the coupling element rows 12. As shown in the sectional view, the top end stop 32 is bent in a U-shape and both ends of the top end stop 32 penetrate partially the fastener tape 16 and the liquid-tight layer 18 and are fused together, thereby ensuring a high attachment strength. If a thermoplastic resin such as polyester, polyacrylic and polyacetal is used as the material of the top end stop 32, the top end stop 32 may be fused integrally with the core thread 14, the sewing yarn 15, the fastener tape 16 and the liquid-tight layer 18. To improve the water repellent performance in the vicinity of the top end stop 32, it is recommended to apply the water repellent agent or oil repellent agent to the top end stop 32 after the top end stop 32 is attached.

Next, the detail in the vicinity of the separable bottom end stop 34 will be described with reference to FIG. 5. As shown in FIG. 5, the separable bottom end stop 34 is attached to the bottom end of the liquid-tight slide fastener 10. The separable bottom end stop 34 includes a box 35 with a box pin 36 and an insert pin 37. A reinforcement film 38 is attached by ultrasonic fusion to only a surface opposite to the liquid-tight layer 18 at a portion equipped with the separable bottom end stop 34. The reason why the reinforcement film 38 is provided on only the single surface is that the reinforcement film 38 cannot be fused with the liquid-tight layer 18 coated with water repellent agent or the like with a sufficient strength.

In the meantime, in an ordinary liquid-tight slide fastener in which the pair of right and left fastener stringers 17 do not need to be separated completely, a bottom end stop (not shown) composed of a single member is attached to the bottom end of the right and left fastener stringers 17 in pair. To improve the water repellent performance in the vicinity of the separable bottom end stop 34 shown in FIG. 5, the water repellent agent or oil repellent agent not requiring heat treatment should be applied to the separable bottom end stop 34 after the separable bottom end stop 34 is attached.

Figure 6:
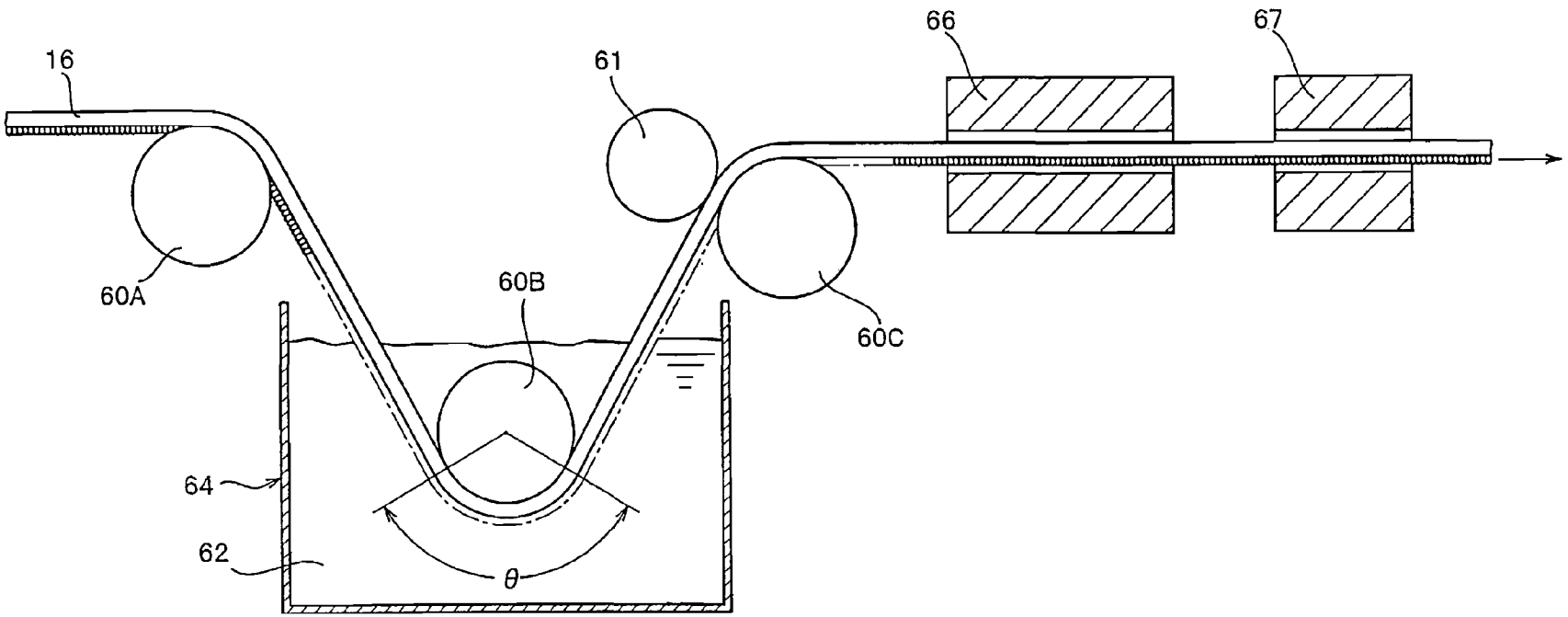
FIG. 6 is a side view showing an embodiment of treatment process in which the liquid-tight slide fastener is dipped into a container filled with a water repellent agent or oil repellent agent and thereafter, drying and affixing processes are carried out continuously.

Next, an example of carrying out water repellent finish treatment continuously to the fastener chain 19 of the liquid-tight slide fastener 10 shown in FIG. 1 will be described with reference to FIG. 6. FIG. 6 is a side view showing treatment process of carrying out drying, fusion, and settlement of a water repellent agent or oil repellent agent 62 continuously by dipping the fastener chain 19 in a container filled with the water repellent agent or oil repellent agent 62.

To carry out application, drying, fusion and settlement of the water repellent agent or oil repellent agent 62 continuously, as shown in FIG. 6, a dipping bath 64, a drying chamber 66, a heat treatment chamber 67, a plurality of guide rollers 60A, 60B, 60C, and a pinch roller 61 are disposed. The dipping bath 64 stores the water repellent agent or oil repellent agent 62 therein. The drying chamber 66 is provided to dry the applied water repellent agent or oil repellent agent by heating the fastener chain 19. In the heat treatment chamber 67, the water repellent agent or oil repellent agent 62 is settled by heating the fastener chain 19. The plurality of guide rollers 60A, 60B, 60C are provided to pass the fastener chain 19 through the dipping bath 64 and the drying chamber 66 by changing the movement direction of the fastener chain 19. The pinch roller 61 removes an excessive water repellent agent or oil repellent agent 62 impregnated in the fastener chain 19.

When carrying out the treatment shown in FIG. 6, first of all, the fastener chain 19 is fed to the peripheral surface of the guide roller 60A from the left side in FIG. 6 so as to change the direction of movement of the fastener chain 19 toward the peripheral surface of the guide roller 60B provided within the dipping bath 64. Within the dipping bath 64, the fastener chain 19 is wound around along the peripheral surface of the guide roller 60B while the water repellent agent or oil repellent agent 62 is impregnated into the fastener chain. The fastener chain is curved at a predetermined angle θ so as to change the direction thereof. Thereafter, the fastener chain is pulled out of the dipping bath 64 and guided by the peripheral surface of the guide roller 60C. Within the dipping bath 64, the water repellent agent or oil repellent agent 62 is applied to the entire surface of the core thread 14, the coupling element rows 12, the sewing yarn 15, the fastener tape 16 and the liquid-tight layer 18.

When the fastener chain 19 is wound around the outer periphery of the roller 60B so as to be curved, the gap between the coupling elements outside is opened slightly with respect to the guide roller 60B due to a difference in curvature radius. Then, the water repellent agent or oil repellent agent 62 penetrates the inside of the coupling element rows 12 through an opening in the coupling element rows 12, thereby accelerating permeation of the water repellent agent or oil repellent agent 62 to the core thread 14 and sewing yarn 15 which are hidden inside the coupling element rows 12.

The fastener chain 19 coming out of the dipping bath 64 is sandwiched between the guide roller 60C and the pinch roller 61 so as to remove the excessive water repellent agent or oil repellent agent 62. The fastener chain 19 is further wound around the peripheral surface of the roller 60C so as to change the direction of movement and then, fed into the drying chamber 66 and the heat treatment chamber 67. The drying chamber 66 executes drying treatment under a condition suitable for drying of the water repellent agent or oil repellent agent 62 corresponding to the type of the water repellent agent or oil repellent agent 62. The heat treatment chamber 67 executes heat treatment under a condition suitable for fusion or settlement of the water repellent agent or oil repellent agent 62 corresponding to the type of the water repellent agent or oil repellent agent 62.

It is recommendable to use a roller wound with elastic silicon rubber for the outer peripheral surface of the pinch roller 61. The fastener chain 19 sufficiently impregnated with the water repellent agent or oil repellent agent 62 is sandwiched and pressed with the guide roller 60C and the pinch roller 61, whereby the water repellent agent or oil repellent agent 62 is allowed to permeate the coupling element rows 12, the core thread 14, the sewing yarn 15 and the inside of the fastener tape 16 uniformly.

By continuously executing impregnation, drying and heat treatment of the water repellent agent or oil repellent agent 62, the water repellent agent or oil repellent agent can be effectively applied to the surfaces of the coupling element rows 12, the core thread 14, the sewing yarn 15 and the fastener tape 16. Then a predetermined water repellent effect or oil repellent effect can be applied to the liquid-tight slide fastener 10.

In the previous description using FIG. 6, explanation will be given to the example of executing the drying treatment and heat treatment by taking out the fastener chain 19 after it is dipped in the dipping bath 64 so as to impregnate with the water repellent agent or oil repellent agent 62. However, the present invention is not restricted to such a manufacturing method. That is, it is permissible to apply the water repellent agent or oil repellent agent 62 to at least the core thread 14 of the fastener chain 19 as described below.

Because the method for manufacturing the liquid-tight slide fastener 10 described below can adopt the treatment process shown in FIG. 2, it will be described according to FIG. 2 again. Of the respective treatments shown in FIG. 2, steps which execute the same treatment as that described previously will be skipped to avoid duplicated description.

In S100 to S104, the same treatment as the same steps described previously is carried out.

In S106 "Apply the water repellent agent or oil repellent agent", treatment of applying the water repellent agent or oil repellent agent is carried out on mainly the core thread 14 sewed onto the fastener chain 19 including the liquid-tight layer 18 with a dispenser or by local shower or spraying.

Although it is necessary to apply the water repellent agent or oil repellent gain to at least the core thread 14 in this example, this includes applying the water repellent agent or oil repellent agent to not only the core thread 14 but also the coupling element rows 12, the sewing yarn 15 or a part of the fastener tape 16.

In S108 "Settle the water repellent agent or oil repellent agent", the water repellent agent or oil repellent agent applied to the core thread 14 is dried by continuously passing the fastener chain 19 in which at least the core thread 14 is supplied with the water repellent agent or oil repellent agent through a drying chamber (not shown) or heat treatment chamber. The drying time is about 2 minutes at 110° C. as described above.

Next, the fusion and settlement treatments accompanying cross-linkage and orientation are carried out by executing heat treatment on the dried water repellent agent or oil repellent agent. Consequently, at least the effective water repellent agent or oil repellent agent adheres to the core thread 14, thereby ensuring a desired water repellent effect or oil repellent effect. The settlement treatment (heat treatment) for the water repellent agent or oil repellent agent is carried out for about 1 minute at 170° C. as described above.

Because in S112 to S114, the same treatments as the steps described above are carried out, description thereof is omitted.

The description based on FIG. 6 has explained the example of continuously dipping the fastener chain 19 into the dipping bath 64. However, the present invention is not restricted to the treatment process of continuously dipping the fastener chain 19 in the dipping bath 64, but a basket storing the fastener chain 19 may be dipped in the dipping bath 64 as it is. Further, the drying treatment and heat treatment for the water repellent agent or oil repellent agent 62 may be carried out by batch treatment instead of continuous treatment.

Figure 7:
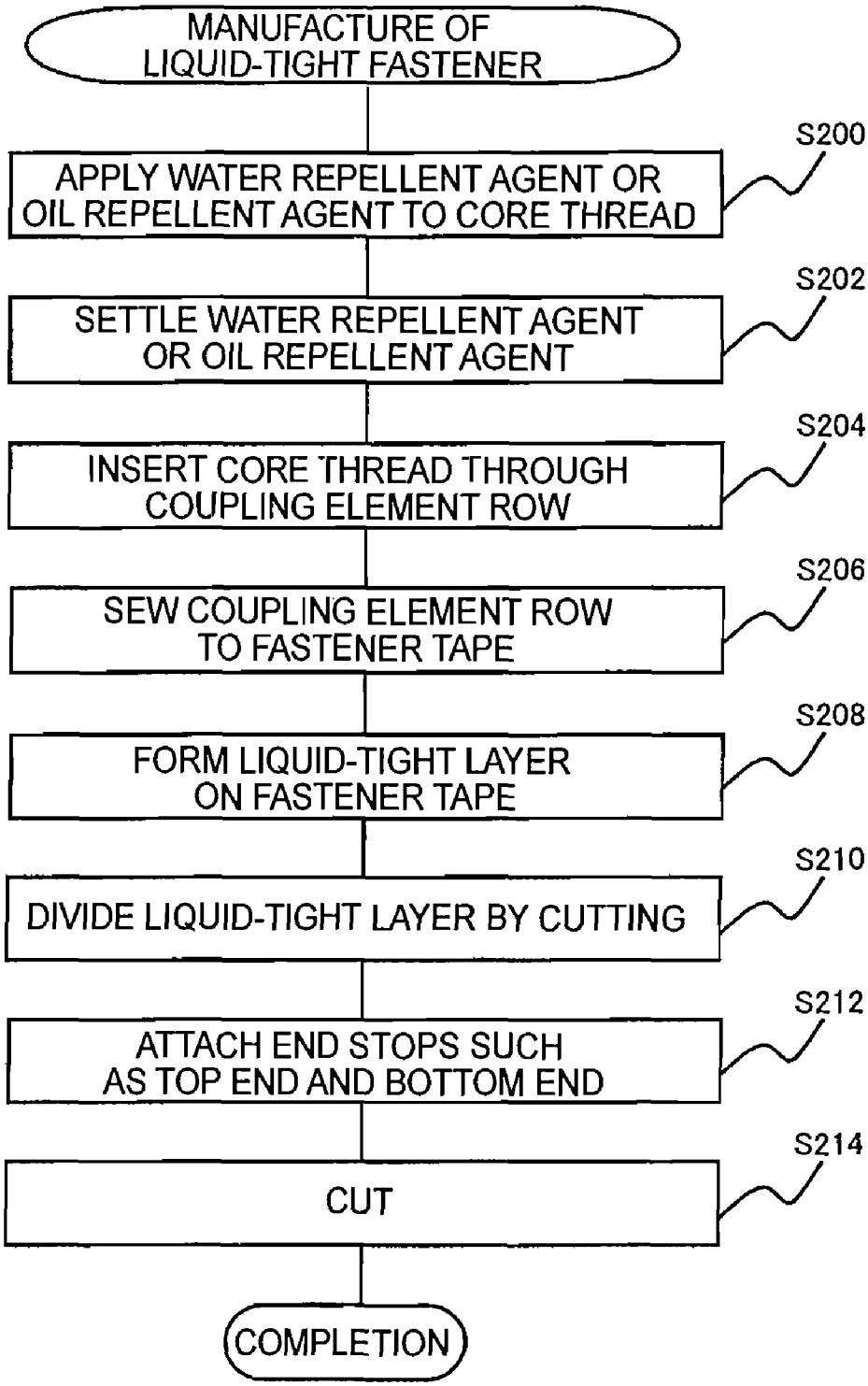
FIG. 7 is a process chart showing a second embodiment of the method for manufacturing the liquid-tight slide fastener.

Next, another method for manufacturing the liquid-tight slide fastener 10, different from the method for manufacturing the liquid-tight slide fastener 10 shown in FIG. 2, will be described with reference to FIG. 7. FIG. 7 is a process chart showing a second embodiment of the method for manufacturing the liquid-tight slide fastener 10, in which the water repellent treatment or oil repellent treatment is carried out on the core thread 14 without executing the water repellent treatment or oil repellent treatment directly on the fastener chain 19 as done in the first embodiment.

That is, upon manufacturing the liquid-tight slide fastener 10 as shown in FIG. 7, in S200 "Apply the water repellent agent or oil repellent agent onto core thread", treatment of applying the water repellent agent or oil repellent agent to the core thread 14 obtained by knitting fibers such as polyester is carried out using a kiss roller, dispenser, shower, or spray or by dipping. In the meantime, although an example of using the fluorinated water repellent/oil repellent agent used in the description of FIG. 2 as an example of the water repellent agent will be described below, the present invention enables various materials as described later to be used and is not restricted to the water repellent/oil repellent agents.

According to this embodiment, it is permissible to apply the water repellent agent or oil repellent agent to only the core thread 14 or the water repellent agent or oil repellent agent 62 to the coupling element rows 12, the fastener tape 16 and the sewing yarn 15 independently so as to further improve the water repellent performance or oil repellent performance. The treatment of applying the water repellent agent or oil repellent agent 62 to the coupling element rows 12, the fastener tape 16 and the sewing yarn 15 may be carried out after the liquid-tight layer is formed on the fastener chain (after the process of S208 described later) like the first embodiment.

Next, in S202 "Settle the water repellent agent or oil repellent agent", the applied water repellent agent or oil repellent agent is dried. Subsequently, the heat treatment is carried out on the dried water repellent agent or oil repellent agent 62 so as to execute the fusion and settlement treatment accompanying cross-linkage and orientation. Consequently, the effective water repellent agent or oil repellent agent adheres to the surface of material of the core thread 14 and the like as described above.

Next, in S204 "Insert the core thread through coupling element rows", the core thread 14 coated with water repellent agent or oil repellent agent is passed through the central portion of the coil-like coupling element row 12.

Next in S206 "Sew the coupling element rows onto fastener element columns", the pair of right and left coil-like coupling element rows 12 through which the core thread 14 is passed are sewed along the opposing side edges of the pair of right and left fastener tapes 16 using the sewing yarn 15.

In subsequent S208, S210, S212, and S214, the liquid-tight slide fastener 10 is completed through the same process as S104, S110, S112, and S114 in the first embodiment.

Available examples of the aforementioned water repellent agent include a fluorine compound, a silicone compound, an acrylic water repellent agent, a silicone complex water repellent agent, a paraffin compound, an ethyleneurea compound, a zirconium compound, a fatty acid amide compound, a methylol amide compound, an alkyl urea type water repellent agent and a fatty amide type water repellent agent.

Available examples of the aforementioned fluorine base compound water repellent agent include polypentadecafluorooctyl acrylate, polytrifluoroethyl acrylate, tetrafluoroethylene-hexafluoropropylene copolymer, perfluoro lauric acid, polytetrafluoroethylene, perfluoro n-alkylacrylate, polyvinylidene-fluoride, pentadecanebutyl ethyl metaacrylate, and hexafluoropropylene.

Available example of other fluorine base compound water repellent agents include a copolymer composed of two or more kinds of olefins containing fluorine atoms, and a copolymer of a hydrocarbon monomer and olefin containing fluorine atoms. In the meantime, preferably, the water repellent agent is applied to woven or knitted fabric together with a binder resin from viewpoints of intensifying the durability of water repellency. The type of the binder resin will be described elsewhere later.

Examples of the silicone base compound include a silicone base water repellent agent composed of polydimethyl siloxane, methylhydrogen polysiloxane, various modified silicons such as amino modified, epoxy modified, carboxyl modified, quaternary ammonium salt modified, higher alkyl modified, and fluorine modified silicons, or methyl hydrogen polysiloxane together with hardening accelerating catalyst of aromatic series such as toluene, xylene, n-hexane, and n-heptane. The silicone base water repellent agent has such advantages: (1) a large angle of contact with water and excellent water repellency, (2) ability of wetting the base material easily so as to form a uniform film due to small surface tension, (3) excellent air permeability, and (4) excellent durability and excellent washing resistance and dry-cleaning resistance.

As the silicone base water repellent agent, available is a room temperature curing silicone emulsion composition which is hardened under room temperature by removing water to provide an elastomer-like hardened material. Examples of the composition include a silicone emulsion composed of hydroxyl-group-containing diorganopolysiloxane stabilized on anion basis, colloid silica and hardening catalyst, described in Japanese Patent Application Laid-Open (JP-A) No. 58-118853 or 60-96650, and a silicone emulsion composed of titanium catalyst and alkoxy-group-containing diorganopolysiloxane stabilized on ion basis or non-ion basis, described in JP-A-7-150045.

Further, a cross-linking agent may be used together for the aforementioned compound in order to improve the durability of the water repellent agent or oil repellent agent. Examples of the cross-linking agent include a melamine resin, a block isocyanate resin, and an imine resin.

To improve the durability of the water repellent agent or oil repellent agent, a binder resin may be contained together with the aforementioned compound. Examples of the binder resin include an acrylic resin, an urethane resin, and a silicone resin.

The cross-linking agent and the binder resin may be used mixedly, and in such a case, a treatment fluid may be a mixed liquid of a polyfluoroalkyl-group-containing acrylic copolymer and an aminoplasto resin or polyfunctional-block-isocyanate-containing urethane resin.

To find out whether or not the water repellent agent or oil repellent agent adheres to the surface of the slide fastener, for example, the angle of contact can be calculated from the shape of droplet by falling an appropriate amount of droplets onto a place where the water repellent agent may adhere to the base material. The angle of contact refers to an angle formed between the surface and the tangent line in the vicinity of the surface of droplet, and it can be said that the larger this angle, the better water repellency is present. The water repellency is clarified by comparing a test piece to which actually the water repellent agent adheres with a test piece to which no repellent agent adheres. In the test piece to which no water repellent agent adheres, the angle of contact is less than 30°. If it is recognized that the water repellent agent adheres or the water repellent agent might adhere according to this method, whether or not any material adheres to the surface can be detected by analysis.

Next, water repellent performance of the liquid-tight slide fastener 10 of the present invention will be described according to a precipitation test method B (shower test) using an artificial precipitation apparatus.

Figure 8:
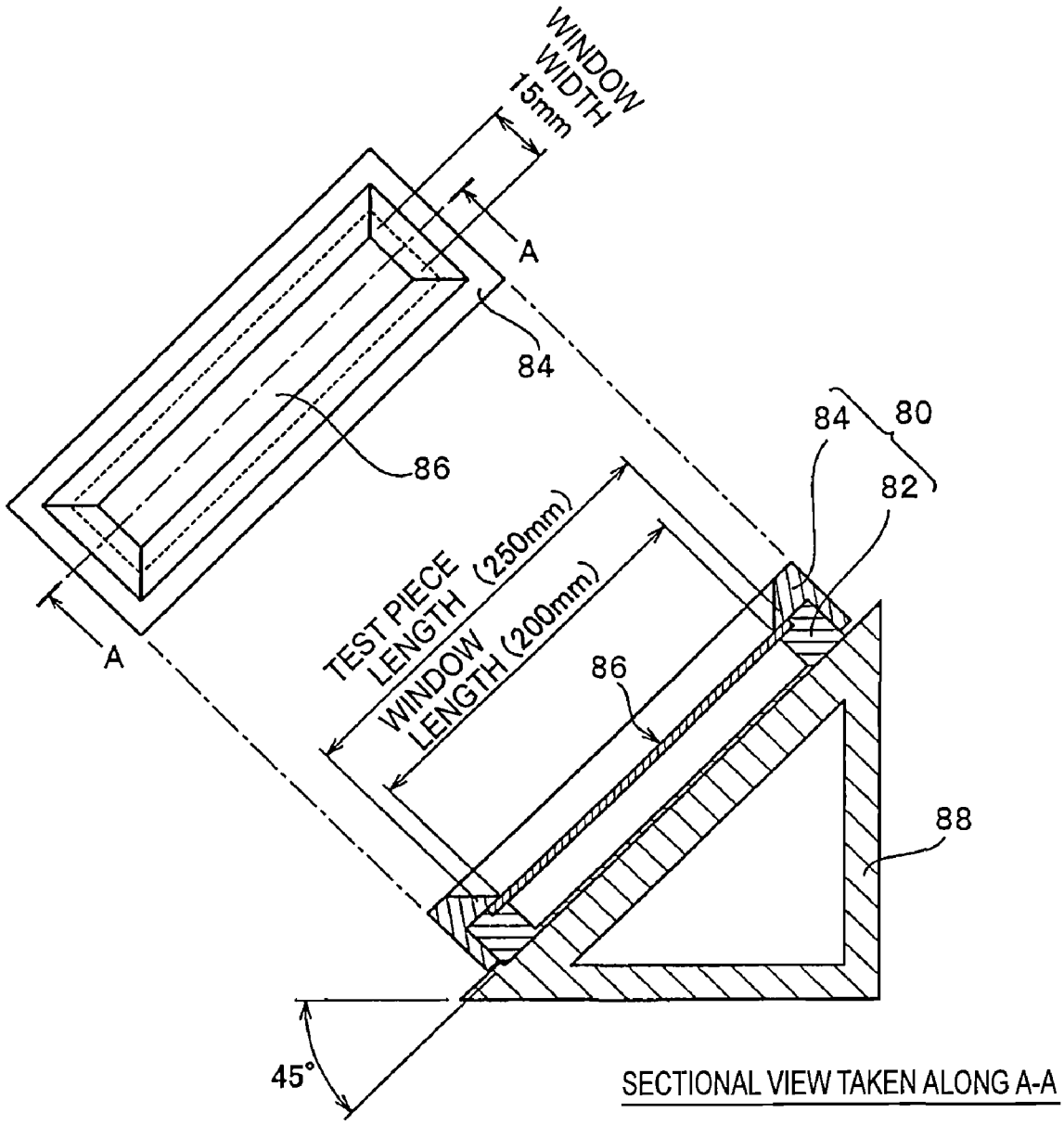
FIG. 8 is a plan view and a side sectional view (taken along line A-A) of a fixing jig for a test piece for use under a precipitation test method B.

First, a fixing jig for the test piece for use in the precipitation test method B will be described by using FIG. 8. FIG. 8 shows a plan view and a side sectional view (taken along the line A-A) of the fixing jig for the test piece for use in the precipitation test method B.

As shown in FIG. 8, the fixing jig 80 includes an opening member 84 having an opening window for allowing water falling from above to strike a test piece 86 and a water storage member 82 having a storage portion for storing water passing the test piece 86. The water storage member 82 is disposed lower the opening member 84. The test piece 86 is sandwiched between the opening member 84 and the water storage member 82 upon usage. According to the precipitation test method B, the fixing jig 80 is fixed at an angle of 45° for the precipitation test using an angle fixing device 88 in order to maintain a predetermined slope so that the test piece 86 is not submerged in water. In the meantime, the dimension of the opening window of the opening member 84 is 200 mm in window length and 15 mm in window width as shown in FIG. 8. The length of the test piece 86 is 250 mm.

Figure 9:
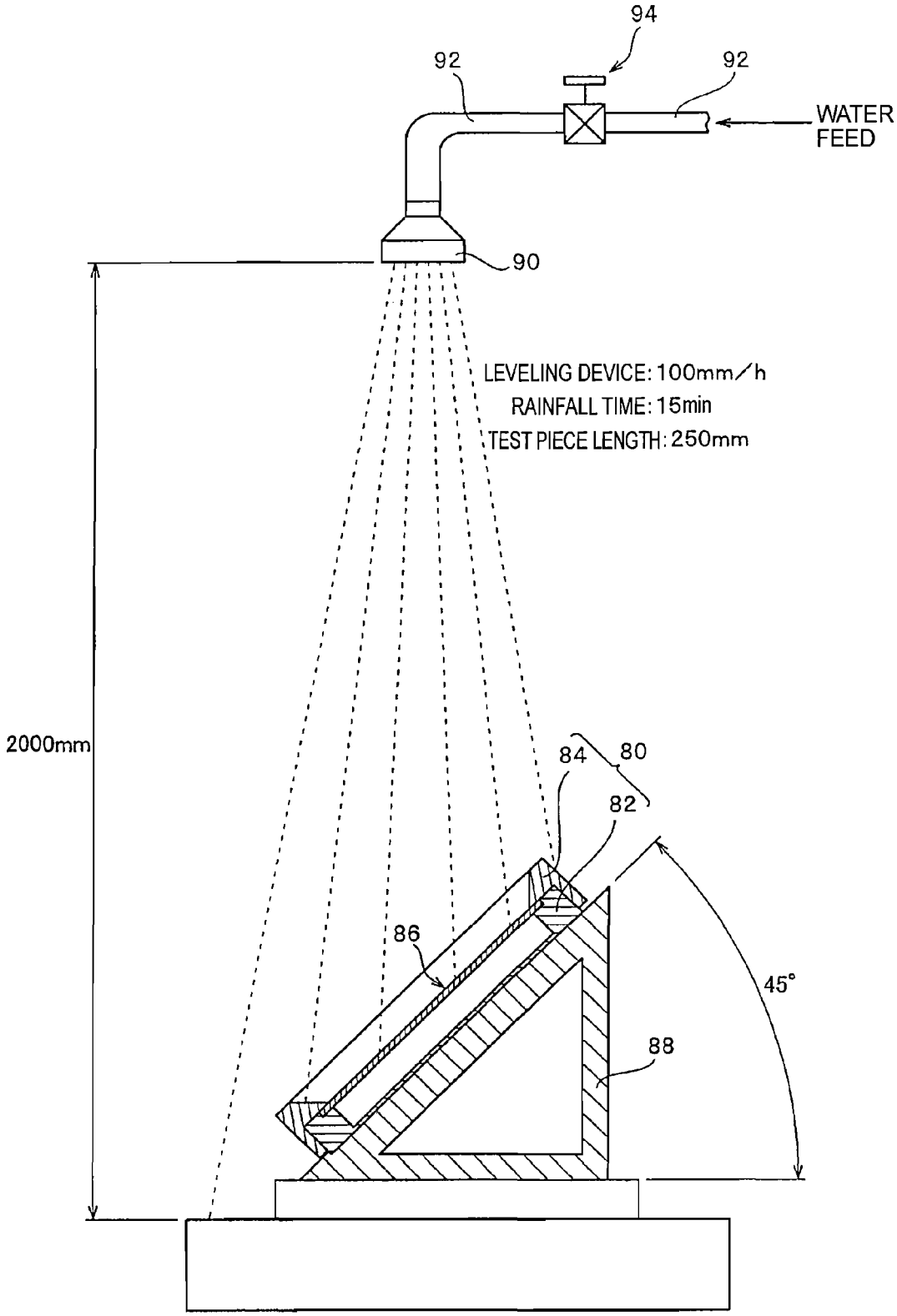
FIG. 9 is a view showing an appearance of an artificial precipitation apparatus for performing the precipitation test method B.

FIG. 9 is a view showing an appearance of the artificial precipitation apparatus when the precipitation test method B is executed. The fixing jig 80 and the angle fixing device 88 are expressed with their sections.

As shown in FIG. 9, the fixing jig 80 to which the test piece 86 is attached is mounted on the angle fixing device 88 and set at an angle of 45°. A spray nozzle 90 for sprinkling water is disposed 2000 mm above the fixing jig 80. A water supply pipe 92 is connected to the spray nozzle 90 so as to feed water therein with pressure. A water amount control valve 94 for adjusting the amount of water to be sprinkled is disposed halfway of the pipe 92.

Upon executing the precipitation test method B, the test piece 86 of the liquid-tight slide fastener is cut out and its mass (M0) prior to the test is weighed in advance. Then, the test piece 86 is sandwiched at a predetermined position between the opening member 84 and the water storage member 82. At the same time, absorbent paper for use in measuring the mass of water passing the test piece 86 by absorbing water deposited inside the water storage member 82 after the test is ended is prepared and an initial mass (M1) of the absorbent paper is weighed in advance.

Next, the fixing jig 80 in which the test piece 86 is sandwiched is placed on the angle fixing device 88 and set at an angle of 45° and then, disposed at a position 2000 mm below the spray nozzle 90. Next, the amount of rainfall is set to 100 mm/h by adjusting the water amount control valve 94 while observing a precipitation gauge. Then, sprinkling of water to the fixing jig 80 is started and the sprinkling of water is stopped after 15 minutes elapse.

After the water sprinkling is ended, first, the test piece 86 is detached from the fixing jig 80 and the mass (M2) of the test piece 86 after the test is measured. By immersing the absorbent paper in water deposit 96 (see FIGS. 10 and 11) inside the water storage member 82, all water collected inside the water storage member 82 is absorbed. Then, the mass (M3) after the absorption is measured.

Next, by calculating the amount of permeation (g)=(M2−M1)+(M3−M1), the amount of permeation of water according to the precipitation test method B is calculated.

Figure 10:
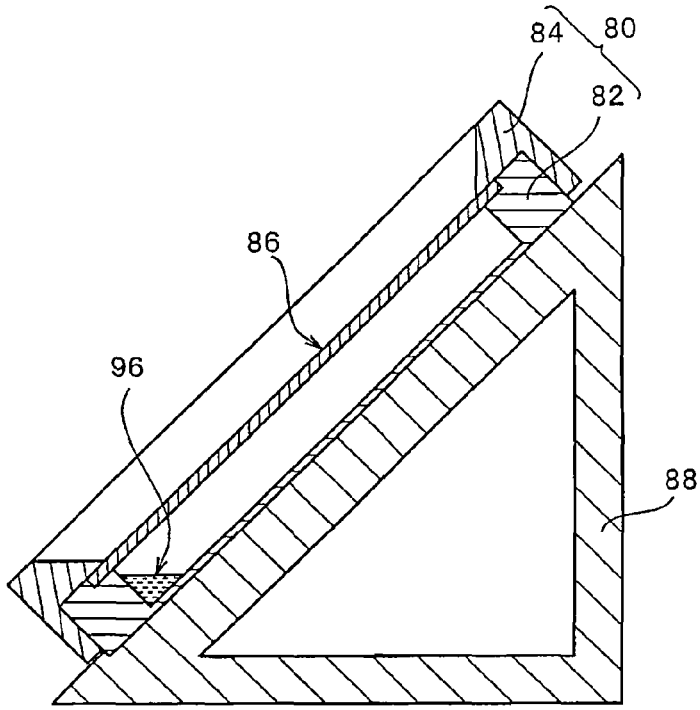
FIG. 10 is a view showing a state in which water penetrating the test piece by spraying is collected inside a water storage member so that water deposit remains.
Figure 11:
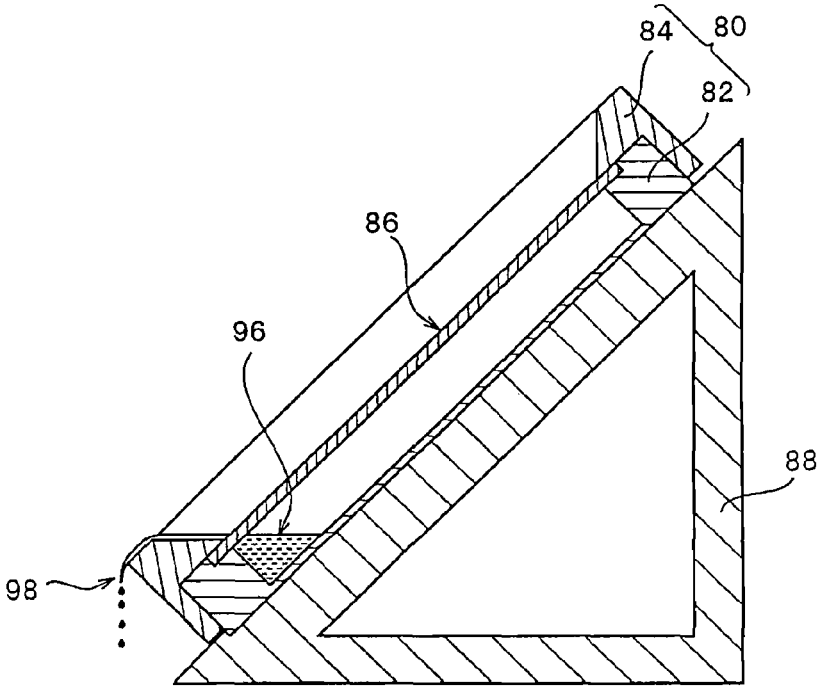
FIG. 11 is a view showing a state in which water penetrating the test piece by spraying is collected inside the water storage member so that a large amount of water remains.
Figure 13:
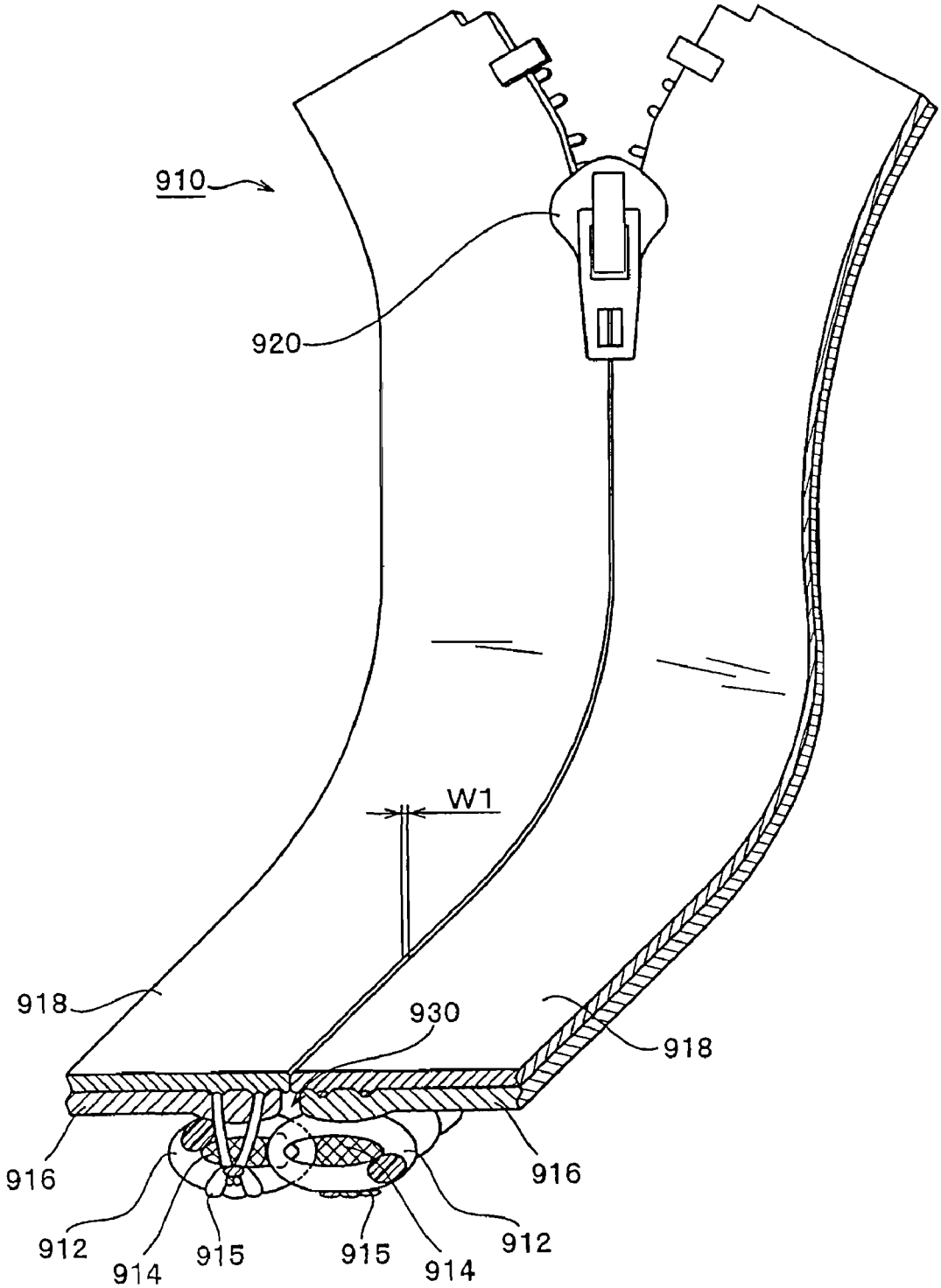
FIG. 13 PRIOR ART
FIG. 13 is a perspective view containing a section of a conventional slide fastener having water repellency.
Figure 14:
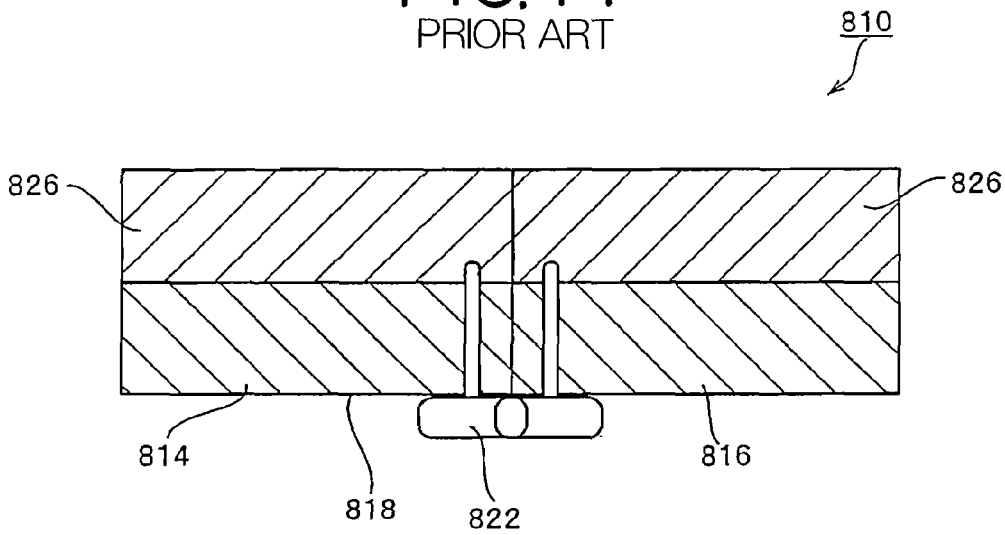
FIG. 14 PRIOR ART
FIG. 14 is a sectional view showing a structure of the conventional slide fastener shown in FIG. 1 of U.S. Pat. No. 6,105,214.
Figure 15:
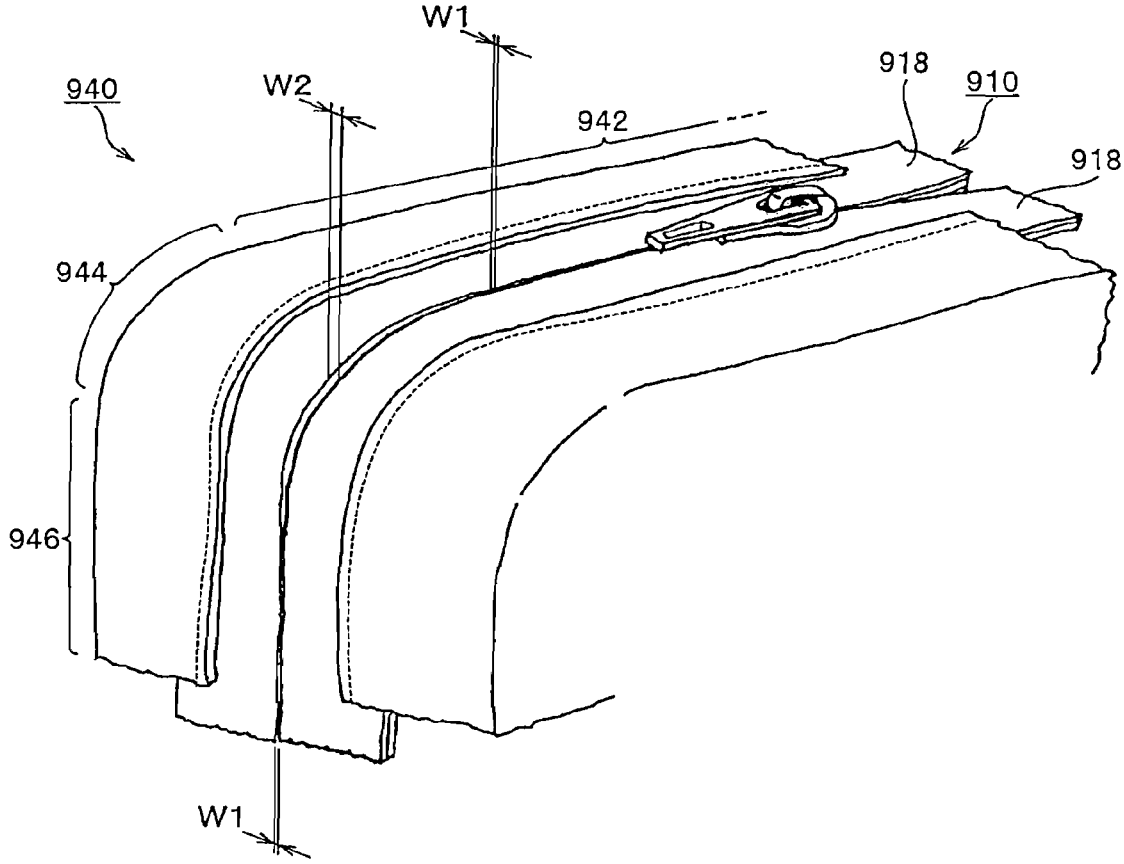
FIG. 15 PRIOR ART
FIG. 15 is a perspective view showing an embodiment in which the conventional slide fastener is used for a bag.

FIGS. 10 and 11 show a state in which water penetrating the test piece 86 by sprinkling is deposited inside the water storage member 82 and the water deposit 96 exists. In the meantime, the fixing jig 80 and the angle fixing device 88 are represented with their sections for convenience for description.

FIG. 10 is a view showing a state in which the water deposit 96 is generated due to penetration of a small amount of water into the water storage member 82 through the test piece 86.

FIG. 11 is a view showing a state in which a large amount of water penetrates into the water storage member 82 due to poor water repellency of the test piece 86 so that a large quantity of water deposit 96 is generated. When water is deposited inside the water storage member 82 up to a status indicated in FIG. 11, water having invaded into the water storage member 82 through the test piece 86 flows out through the test piece 86, thereby causing overflow 98. Thus, attention is needed when measuring the amount of permeation.

FIG. 12 shows a result of performing the precipitation test on the liquid-tight slide fastener of the present invention and a conventional polyurethane film provided fastener.

As a sample of the conventional fastener provided with a polyurethane film, a test piece having a chain width of 5.8 mm, in which no water repellent agent was applied to the core thread, the coupling element rows, the sewing yarn and the fastener tape, was taken and the amount of water permeation was measured (test piece (1) for comparison)).

As Example 1 of the liquid-tight slide fastener of the present invention, the test piece (1) having the chain width of 5.8 mm, in which the fluorinated water repellent/oil repellent agent was applied to the core thread, coupling element rows, sewing yarn, fastener tape and polyurethane liquid-tight layer according to the impregnation method, was used so as to measure the amount of water permeation (test piece (2) of Example 1).

Further, as Example 2 of the present invention, a test piece in which a fluorinated water repellent/oil repellent agent is applied to all surfaces except a polyurethane liquid-tight layer, was used so as to measure the amount of water permeation (test piece (3) of Example 2).

As a result of the precipitation test, when the polyurethane film provided fastener of the conventional test piece (1) was used, an average value of the permeation amount was 1.99 g. As for the test piece (2) of Example 1 of the present invention in which the fluorinated water repellent/oil repellent agent was applied to all surfaces including the liquid-tight layer, an average value of the water permeation was 0.018 g. Further, as for the test piece (3) of Example 2 of the present invention in which the fluorinated water repellent/oil repellent agent was applied to all surfaces except the liquid-tight layer, an average value of the water permeation was 0.021 g.

Particularly, in the liquid-tight slide fastener of the test piece (2) of Example 1 of the present invention, as shown in FIG. 12, all mass of water calculated as the amount of permeation is the mass of water which permeated the fastener portion, and no water having passed to the inside of the water storage member 82 was detected. That is, when the liquid-tight slide fastener of the present invention is used in a bag, clothes or the like, it comes that no water permeates the inside thereof even if water is splashed over from outside.

What is claimed is:

1. A liquid-tight slide fastener, comprising:

a pair of right and left coil-like coupling element rows, each coil-like coupling element row being sewn to an opposing side edge of a pair of right and left fastener tapes;

a pair of core threads passing through the pair of coil-like coupling element rows, wherein the core threads, but not the coupling element rows, are coated with a water repellant agent or oil repellant agent; and a pair of liquid tight layers formed on the pair of right and left fastener tapes, so that opposing side edges of the liquid tight layers are in contact when the pair of right and left coil-like coupling element rows are coupled, wherein the liquid tight layers are formed on surfaces of the right and left fastener tapes that are opposite to surfaces to which the coil-like coupling element rows are attached, and wherein the liquid tight layers extend to the edges of the fastener tapes.

2. The liquid-tight slide fastener according to claim 1, wherein the fastener tapes are coated with the water repellent agent or oil repellent agent.

* * * * *

UNITED STATES PATENT AND TRADEMARK OFFICE

CERTIFICATE OF CORRECTION

PATENT NO. : 8,327,509 B2
APPLICATION NO. : 12/024216
DATED : December 11, 2012
INVENTOR(S) : Masahiro Kusayama It is certified that error appears in the above-identified patent and that said Letters Patent is hereby corrected as shown below:

In column 12, line 60, Delete “metaacrylate,” and insert -- methacrylate, --, therefor.

In column 13, line 43, Delete “aminoplasto” and insert -- aminoplast --, therefor.

Signed and Sealed this
Twelfth Day of March, 2013

Teresa Stanek Rea
*Acting Director of the United States Patent and Trademark Office*